US006452322B1

(12) United States Patent
Mukuno et al.

(10) Patent No.: US 6,452,322 B1
(45) Date of Patent: Sep. 17, 2002

(54) CATHODE-RAY TUBE AND ITS GETTER SUPPORTER

(75) Inventors: Takashi Mukuno, Tokyo; Tetsuhiko Makino; Tsutomu Suehiro, both of Kanagawa, all of (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/442,733

(22) Filed: Nov. 18, 1999

(30) Foreign Application Priority Data

Nov. 27, 1998 (JP) ..... 10-336833

(51) Int. Cl.[7] ..... H01J 29/94

(52) U.S. Cl. ..... 313/481; 313/559; 313/560; 417/48

(58) Field of Search ..... 313/481, 553, 313/559, 560, 546; 417/48

(56) References Cited

U.S. PATENT DOCUMENTS 4,061,945 A 12/1977 Benda et al.
5,977,706 A * 11/1999 Cho et al. ..... 313/481 X
6,310,435 B1 * 10/2001 Hageluken et al. ..... 313/481

FOREIGN PATENT DOCUMENTS

GB 2 295 267 5/1996

* cited by examiner

*Primary Examiner*—Ashok Patel
(74) *Attorney, Agent, or Firm*—Rader, Fishman & Grauer PLLC; Ronald P. Kananen, Esq.

(57) ABSTRACT

A getter supporter of a cathode-ray tube according to the present invention comprises a mounting portion to be fixed to an inside of the cathode-ray tube at one end thereof, a getter holder for holding a getter at the other end thereof, and a spring portion for connecting the mounting portion and the getter holder, in which a contact support portion contacting with the inner surface of the funnel is provided on the spring portion at a position spaced apart in the longitudinal direction from the position of the getter holder. Accordingly, fine cracks of the funnel glass due to heat generation of the getter at getter flashing and heat generation of the contact support portion due to high frequency for heating can be prevented, and also the deformation of the getter supporter by the heat conducted to the contact support portion and the spring pressure can be prevented.

5 Claims, 7 Drawing Sheets

CATHODE-RAY TUBE AND ITS GETTER SUPPORTER

BACKGROUND OF THE INVENTION

1. Field of the Invention

The present invention relates to a cathode-ray tube used as a display device of a television receiver and the like, and the structure of a getter supporter used in a flat display device and its applications.

2. Description of the Related Art

In a cathode-ray tube (CRT), the degree of vacuum in the tube must be maintained below a specified decompressed pressure. For this purpose, after evacuating in the manufacturing process, a getter mainly composed of barium and the like contained in the tube is heated to evaporate, and the residual gas in the tube and the gas generated in the tube after sealing are absorbed thereby.

FIG. 1 is a sectional view showing a cathode-ray tube having a getter on the inner surface of a funnel.

In FIG. 1, reference numeral 10 is a cathode-ray tube, and a tube body thereof is formed of a panel 11 and a funnel 12 mutually fused or melt-bonded and a fluorescent screen is formed by coating a fluorescent material on the inner surface of the panel 11.

Closely to the fluorescent screen, an aperture grille of a color selection electrode is disposed, and is supported by a frame 13. The frame 13 is fixed to panel pins buried in the panel 11. The frame 13 further is attached with an internal magnetic shield 14 to prevent effects of earth magnetism. Moreover, an electron gun 15 is accommodated in the neck portion of the funnel 12.

The cathode-ray tube 10 having such constitution is electrically sealed while evacuating the gas in the tube after the above parts to be disposed the tube are attached. The degree of vacuum in the tube at this time is about $5\times10^{-5}$ torr, but it is not enough for operating the cathode-ray tube 10 normally, and therefore a getter 30 is preliminarily sealed in the tube in order to further enhance the degree of vacuum so as to be lower than $5\times10^{-5}$ torr.

The getter 30 is affixed to the tip end of a getter supporter 20 attached to an anode button 16 of the funnel 12, and is disposed closely to the inner surface of the funnel 12.

As the getter, generally, a mixture of $BaAl_4$ alloy and Ni is used. In the getter flashing process, after evacuating and sealing electrically, this getter is heated by induction from outside by using a high frequency coil. At this time, at the getter temperature of 800 to 840° C., an exothermic reaction (thermite reaction) takes place, and this reaction heat is added to elevate the temperature quickly, and Ba begins to evaporate (dissipate) at 1130° C., and the temperature rise of the getter 30 further continues up to 1300° C.

Therefore, in this cathode-ray tube 10, by heating the getter 30 and dissipating its vapor, the gas within the tube is securely absorbed and adhered, so that a necessary degree of vacuum is maintained, and lowering of electron emission performance of the cathode is prevented.

FIG. 2 is an explanatory diagram in which a getter is mounted on a funnel by using a conventional getter supporter.

In FIG. 2, reference numeral 20 is a getter supporter, and a getter holder 22 and a contact support part 24 are provided at its tip end. The getter 30 is a thin disk-shape, and it is welded and affixed to the getter holder 22.

A mounting unit 21 of the getter supporter 20 is press-fitted and fixed to a bump of an anode button 16 provided at a specified position of the funnel 12.

The getter 30 is supported by the contact support part 24 by keeping a proper distance of 3 to 5 mm from the glass surface of the funnel 12 so as to be induction-heated by a high frequency coil. In order that this contact support part 24 may not floated from the glass surface of the funnel 12, a spring 23 is given with an adequate spring property so that an adequate spring pressure may be applied to the contact support part 24.

FIG. 3 is a magnified sectional view showing the contact support portion 24 of the conventional getter supporter 20.

As shown in FIG. 3, in the conventional getter supporter 20, the contact support portion 24 contacting with the glass surface of the funnel 12 is designed to support the getter 30 nearly at the central position of the getter 30. Accordingly, it is possible that the temperature rise of the getter 30 may be directly transmitted to the glass surface of the funnel 12, and hence there is a fear that fine glass cracks and the getter supporter deformation may occur.

Also in the conventional getter supporter 20 as shown in FIG. 3, since the getter supporter 20 has the spring property so that the contact support portion 24 may not float above the glass surface of the funnel 12, the high temperature of the getter 30 is transmitted to the getter supporter 20 when flashing the getter 30. When the spring pressure of the getter supporter 20 is too strong, the getter supporter 20 is likely to be deformed by its pressure and heat.

FIG. 4 is a diagram showing a modified example of a conventional getter supporter. The deformation of the getter supporter 20 varies with the heat resistance of the supporter, and the temperature and the pressure applied to the supporter (especially near the getter).

FIG. 5 presents a graph showing the relation between the spring pressure and the heat applied to the getter supporter and the amount of its deformation.

In FIG. 5, a line A and a line B show modified examples of the conventional getter supporter. As shown in the line A or the line B, when the spring pressure of the getter supporter is increased, the deformation of the getter supporter is increased accordingly.

In the conventional getter supporter, in order to keep constant the distance between the glass surface of the funnel glass and the getter, it is designed to support the getter nearly at the central position of the getter. It brings about the following two problems.

1. For getter flashing, the getter is heated at a high temperature from outside of the funnel glass by a high frequency, and the temperature of the getter at this time reaches as high as about 1300° C. as the reaction heat is added, and this heat is conducted to the contact support portion. Therefore, if the distance between the getter and the contact support portion is short, the temperature of the funnel glass contact portion becomes high, and unfavorable fine glass cracks may be formed.

2. If the contact support portion of the getter supporter is floated from the funnel glass, contact vibration noise may be generated when subjected to vibration or impact. To prevent this, an adequate spring pressure is applied to the contact support portion, but if this spring pressure is too strong, the getter supporter is likely to be deformed by the heat at the getter flashing.

SUMMARY OF THE PRESENT INVENTION

The present invention is devised to solve such problems of the conventional getter supporter, and its object is to present a display device and a getter supporter having such a structure so as not to cause any glass or crack cause deformation of getter supporter by the heat at the getter flashing.

A cathode-ray tube of the present invention comprises a getter supporter which has a mounting portion to be fixed to the inside of the cathode-ray tube at one end thereof, a getter holder for holding a getter at the other end thereof, and a spring portion for connecting the mounting portion and the getter holder, in which a getter supporter is provided with a contact support portion contacting with the inner surface of the funnel on the spring portion at a position spaced apart in the longitudinal direction from the holding position of the getter.

A getter supporter of a cathode-ray tube of the present invention comprises a mounting portion to be fixed to the inside of the cathode-ray tube at one end thereof, a getter holder for holding a getter at the other end thereof, and a spring portion for connecting the mounting portion and the getter holder, in which a contact support portion contacting with the inner surface of the funnel is provided on the spring portion at a position spaced apart in the longitudinal direction from the holding position of the getter. Accordingly, fine cracks of the funnel glass due to heat generation of the getter at getter flashing and heat generation of the contact support portion due to the high frequency for heating can be prevented, and also deformation of the supporter by the heat conducted to the contact support portion and the spring pressure can be prevented.

A getter supporter of a flat display device of the present invention comprises a mounting portion to be fixed to the inside of the device at one end thereof, a getter holder for holding a getter at the other end thereof, and a spring portion for connecting the mounting portion and the getter holder, in which a contact support portion contacting with the panel glass is provided on the spring portion at a position spaced apart in the longitudinal direction from the holding position of the getter. Accordingly, fine cracks of the panel glass due to heat generation of the getter at getter flashing and heat generation of the contact support portion due to high frequency for heating can be prevented, and also deformation of the supporter by the heat conducted to the contact support portion and the spring pressure can be prevented.

DETAILED DESCRIPTION OF THE PREFERRED EMBODIMENT

An embodiment of the present invention is described by referring to the accompanying drawings.

Figure 6A:
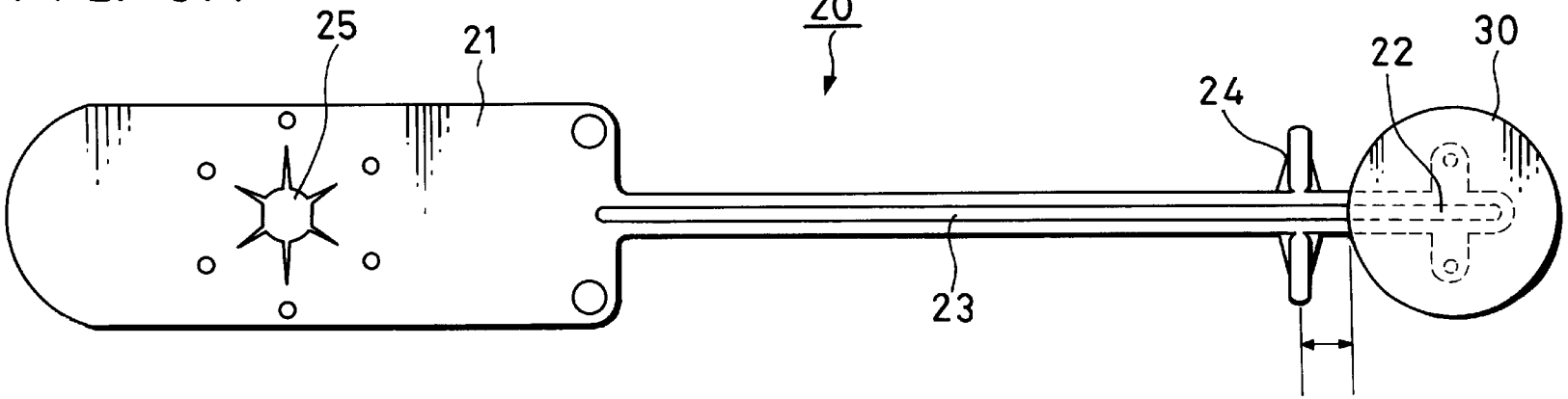
FIG. 6A is a top view of a getter supporter according to the present invention.
Figure 6B:
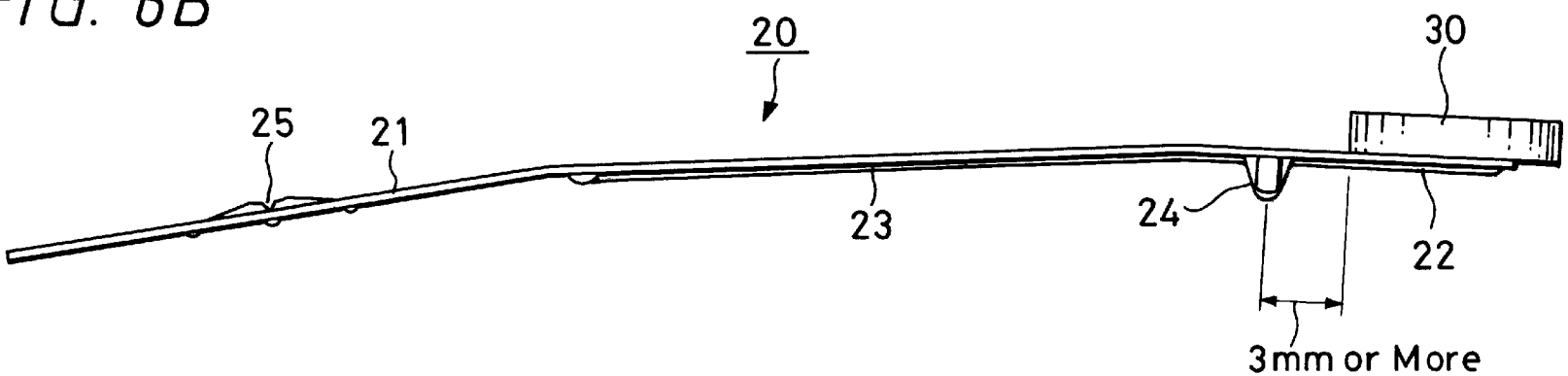
FIG. 6B is a side cross sectional view of the getter supporter according to the present invention.

FIG. 6A is a top view of a getter supporter according to the present invention, and FIG. 6B is a side cross sectional view of the getter supporter according to the present invention.

In FIGS. 6A and B, reference numeral 20 is a getter supporter of the present invention. Reference numeral 21 is a mounting portion for fixing an end of the getter supporter 20 to the inside of a cathode-ray tube. Reference numeral 22 is a getter holder for holding a getter at a tip end of the getter supporter 20. Reference numeral 23 is a spring portion for connecting the mounting portion 21 and the getter holder 22. Reference numeral 24 is a contact support portion provided in the spring portion 23 and serving as a fulcrum for contacting with a funnel glass. Reference numeral 30 is a getter to be mounted on the getter holder 22. In the mounting portion 21 of the getter supporter 20, a hole 25 is provided to be press-fitted and fixed in a bump or projection of an anode button of the cathode-ray tube.

Figure 7:
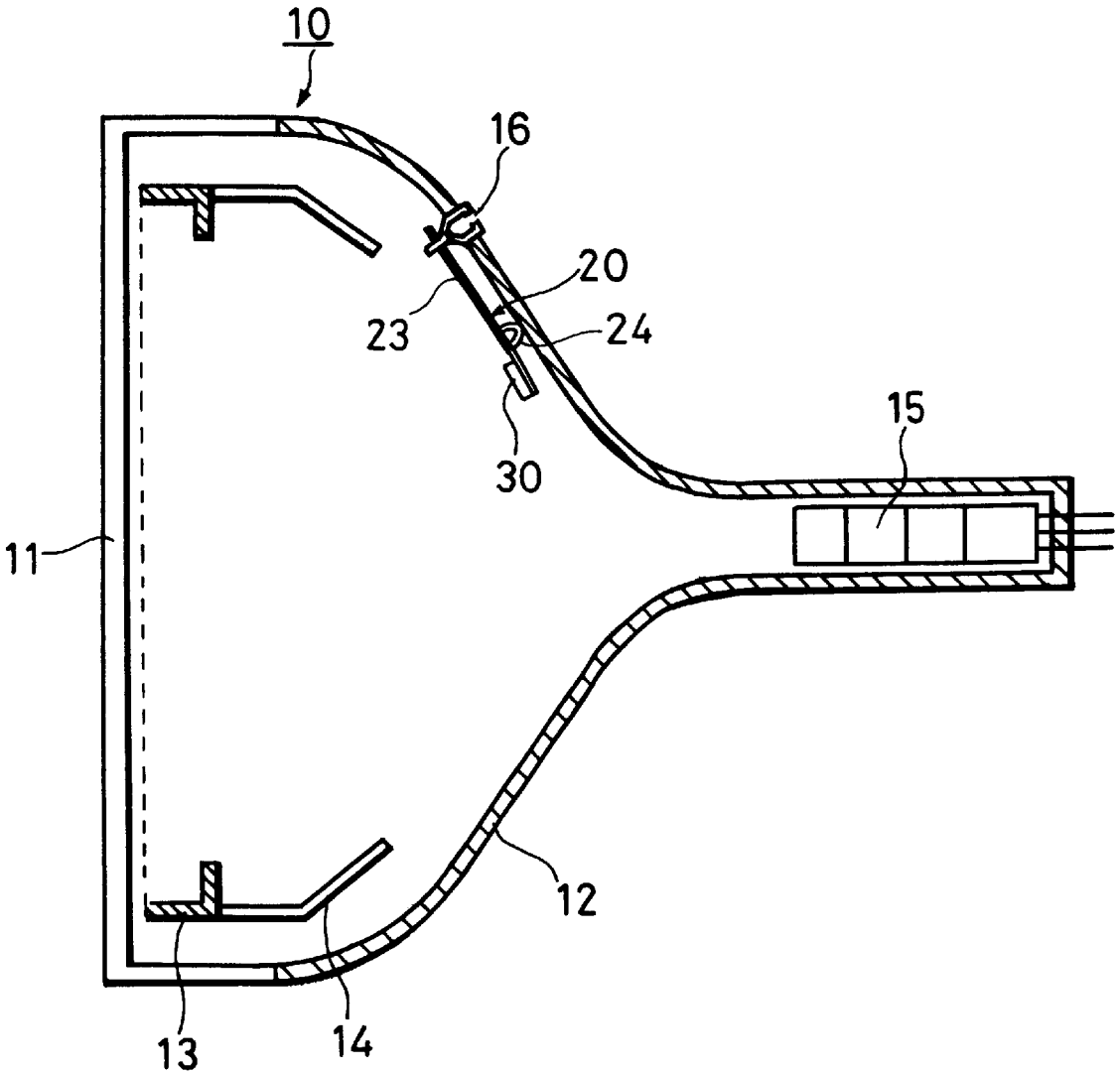
FIG. 7 is an explanatory diagram of mounting a getter on a cathode-ray tube by using the getter supporter of the present invention.

FIG. 7 is an explanatory diagram of mounting the getter 30 on the cathode-ray tube by using the getter supporter 20 of the present invention.

In FIG. 7, the getter supporter 20 of the present invention is fixed by press-fitting the hole 25 of the mounting portion 21 to the bump of an anode button 16 of a funnel 12 of a cathode-ray tube 10. The getter 30 is affixed to the tip end of the getter supporter 20, and supported by the contact support portion 24 of the spring portion 23 of the getter supporter 20 and disposed near the inner surface of the funnel 12.

Since the getter supporter 20 of the present invention is provided with the contact support portion 24 which is spaced from the getter 30 in the longitudinal direction, it is possible to prevent fine cracks of funnel glass due to heat generation of getter when flashing the getter and heat generation of the support portion by high frequency for heating.

Moreover, in order to prevent deformation of getter supporter 20 by the heat applied to the contact support portion 24 and the spring pressure, as shown in FIGS. 6A and B, the contact support portion 24 is positioned at a position by a distance of 3 mm or more to the mounting portion 21 side from the welding point of the getter holder 22 and the outer circumference of the getter 30.

In such constitution, in the getter supporter 20 of the present invention, the distance from the getter 30 to the funnel glass contact point is about twice as long as in the conventional getter supporter, so that the conduction of heat from the getter 30 to the contact point of the funnel glass can be considerably suppressed.

At the same time, since the position of the contact support portion 24 is remote from the center of the high frequency coil to be installed in match with the center of the getter, heat generation by induction heating of the contact support portion 24 directly by high frequency can be decreased. Therefore, formation of fine cracks in the funnel glass due to temperature rise of the contact support portion 24 can be prevented.

Still more, in the getter supporter 20 of the present invention, since the contact support portion 24 is remote from the outer circumference of the getter by 3 mm or more to the mounting portion 21 side, the spring pressure is applied to the getter supporter 20 only from the mounting portion 21 to the contact support portion 24. Moreover, since the heat conducted to the getter supporter 20 is less, the getter supporter 20 is not deformed even if the spring pressure is increased.

Figure 1:
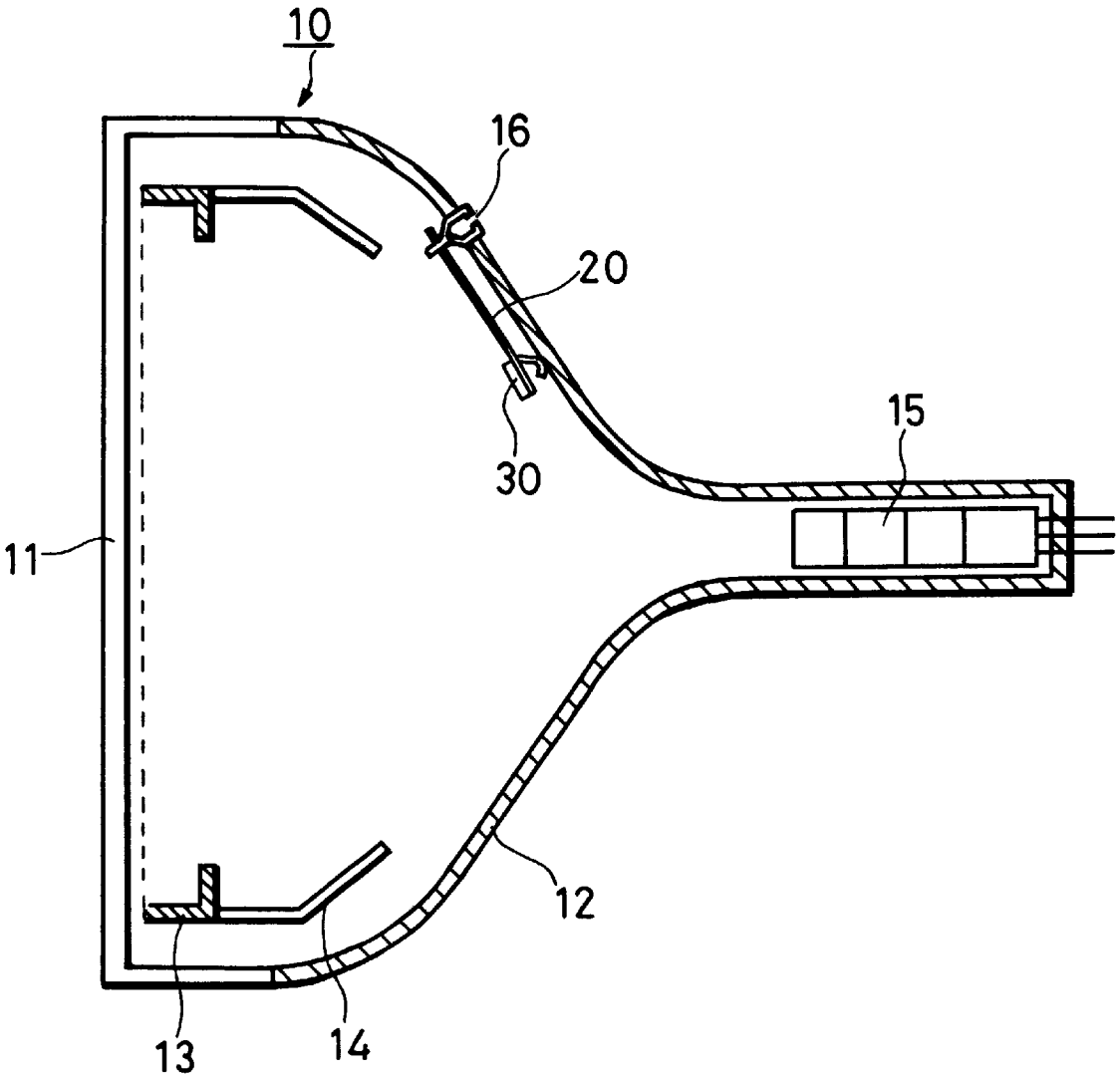
FIG. 1 is a sectional view showing a cathode-ray tube having a getter on the inner surface of a funnel.
Figure 2:
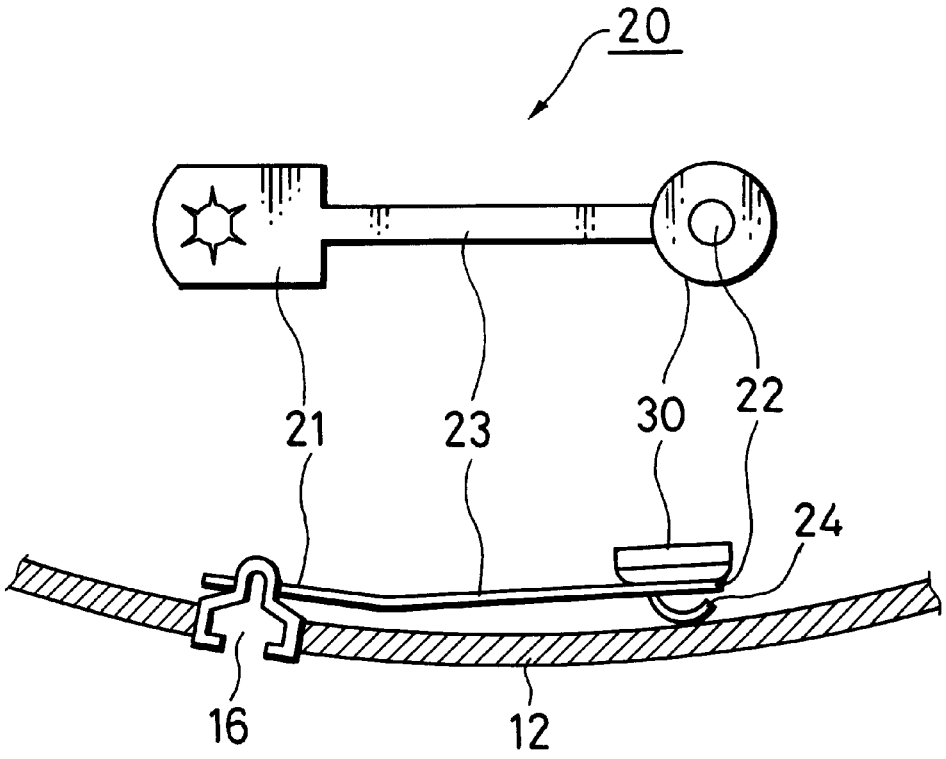
FIG. 2 is an explanatory diagram of mounting a getter on a funnel by using a conventional getter supporter.
Figure 3:
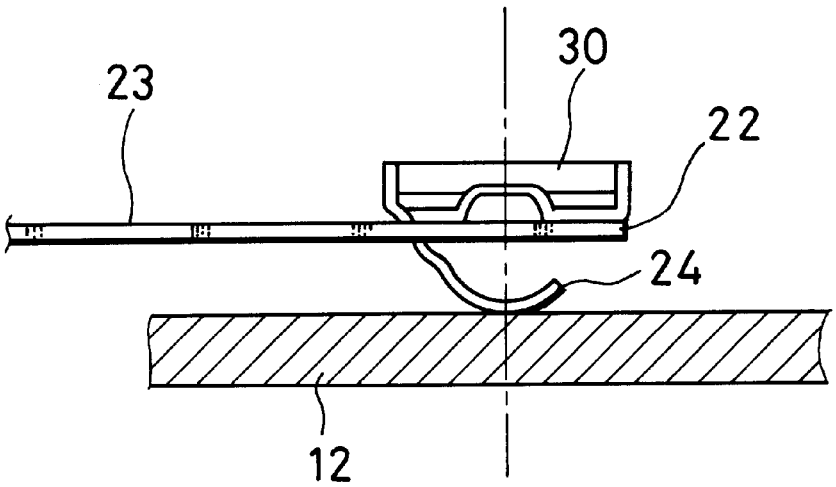
FIG. 3 is a magnified sectional view of a contact support portion of the conventional getter supporter.
Figure 4:
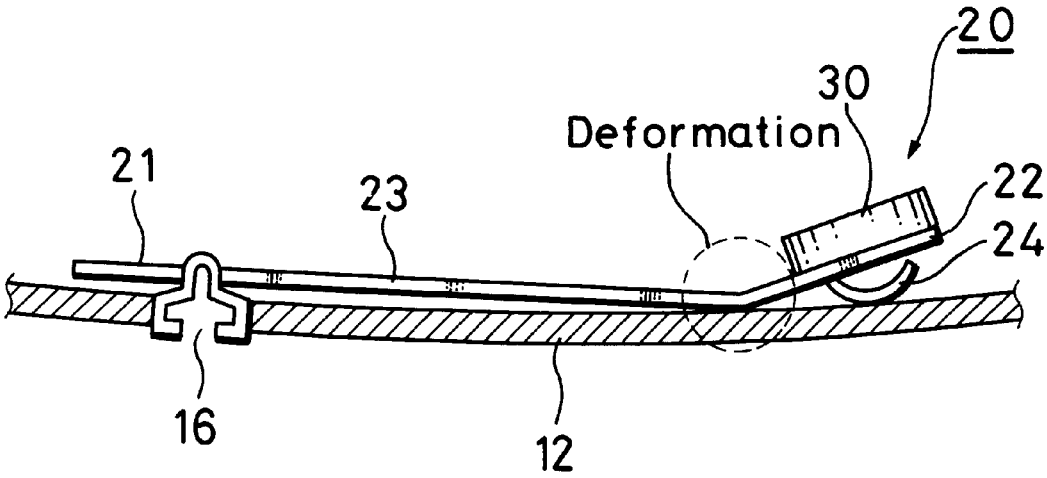
FIG. 4 is a diagram showing a modified example of the conventional getter supporter.
Figure 5:
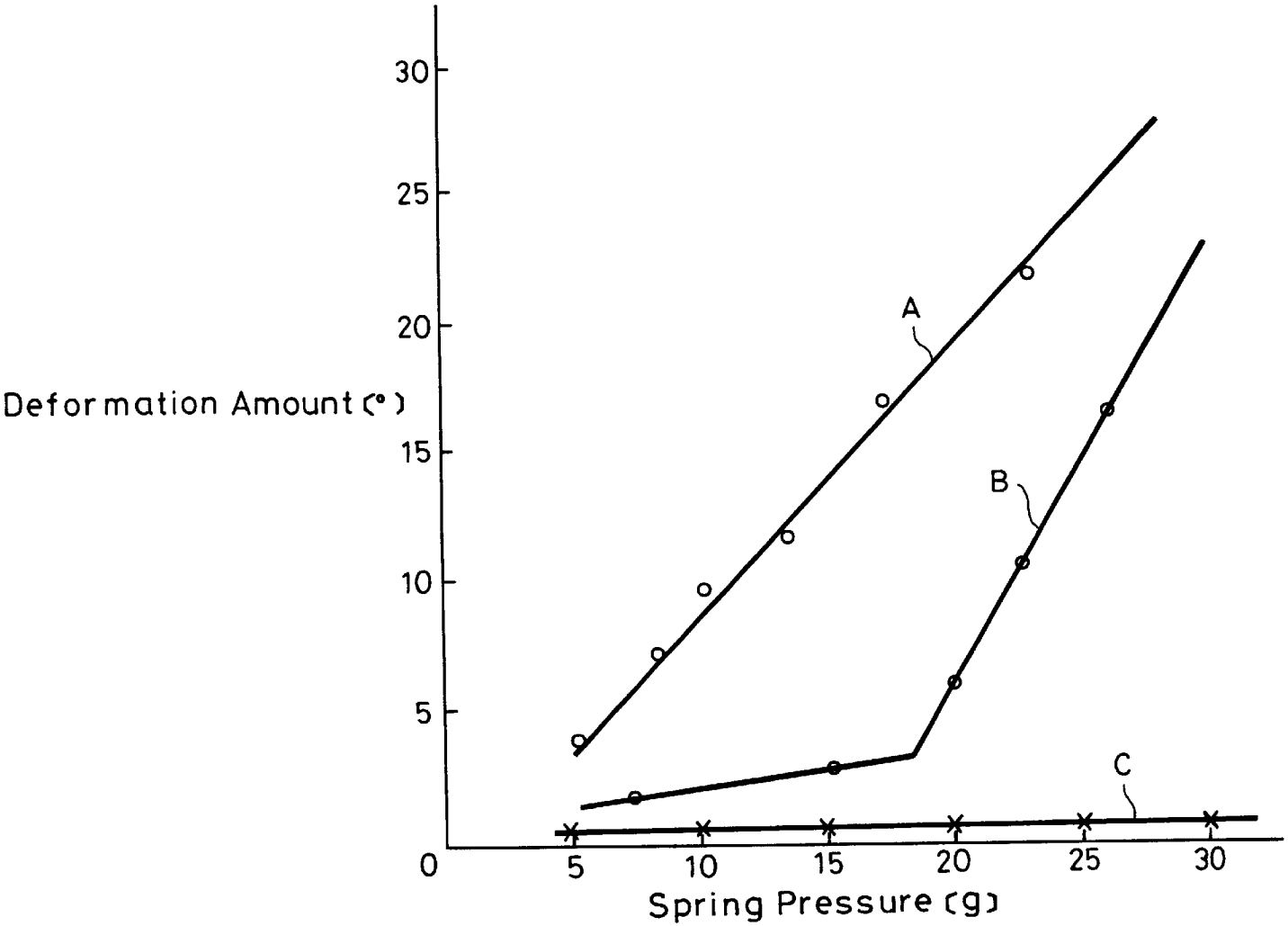
FIG. 5 presents a graph showing the relation between the spring pressure and heat applied to the getter supporter and amount of deformation deformed.

A line C in the graph of FIG. 5 shows the characteristic of the getter supporter 20 of the present invention. As will be clear from the line C in the graph of FIG. 5, the getter supporter 20 of the present invention is not deformed even if the spring pressure is increased. In the foregoing explanation, the getter supporter 20 is mounted by press-fitting the hole 25 against the anode button 16, but the getter supporter 20 of the present invention is not limited to this mounting method only.

As the fixing and mounting method of the getter supporter in the cathode-ray tube, alternatively, the getter supporter may be welded to the internal magnetic shield or frame of the cathode-ray tube or may be welded to the electron gun of the cathode-ray tube and so on, but any method is applicable. The contacting position of the contact support portion 24 is not limited to the funnel glass, but it may be other place such as the internal magnetic shield, frame, electron gun or other place in the cathode-ray tube.

The actual funnel shape of the cathode-ray tube differs slightly depending on the shape and size of the cathode-ray tube, and in order to maintain an adequate spring pressure, it is required to adjust the shape of the getter supporter with every model of the cathode-ray tube. Accordingly, in the conventional getter supporter, the number of types thereof is increased. By contrast, by using the getter supporter of the present invention, there is an enough allowance in the spring pressure and it can be used commonly, so that the variety of the getter supporters can be decreased.

According to the getter supporter of the present invention, the manufacturing allowance is widened such as the getter flashing condition or the like, and fine cracks of funnel glass can be prevented from being generated. Owing to these reasons, by using the getter supporter of the present invention, art the manufacturing cost of the cathode-ray tube is considerably reduced.

The getter supporter of the present invention may be applied to a flat display device with a vacuum inside structure such as a plasma display panel (PDP), a field emission display (FED) and so on.

Figure 8:
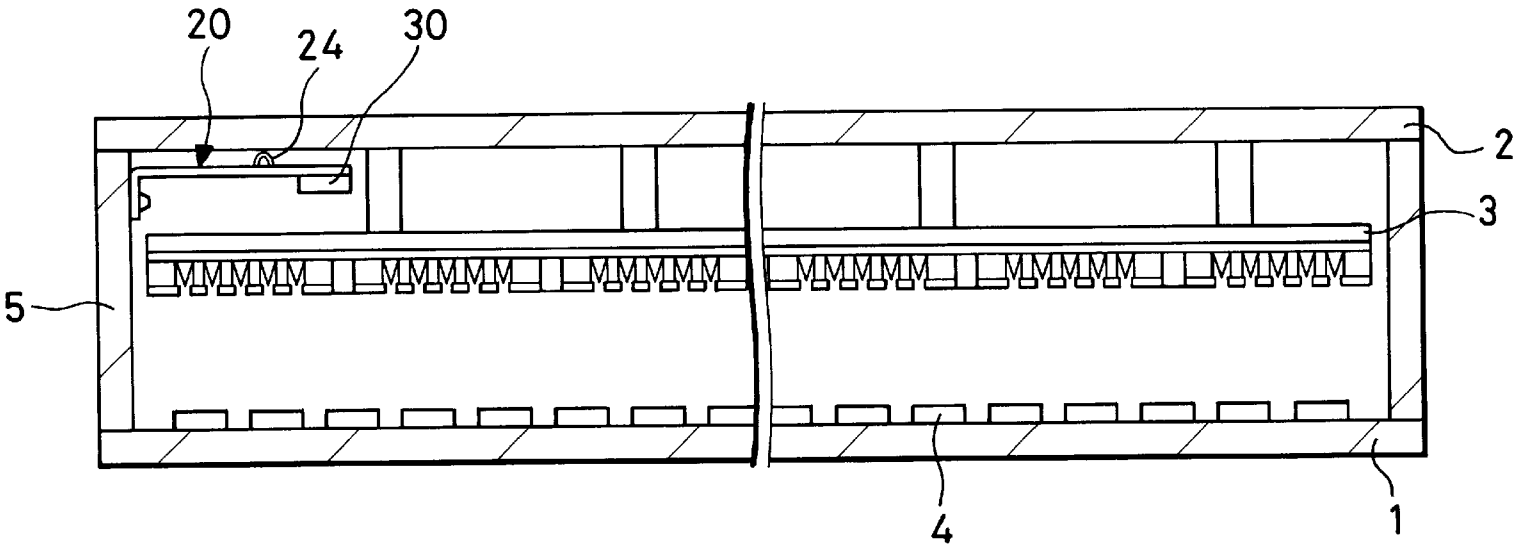
FIG. 8 is an explanatory diagram of mounting the getter on a field emission display by using the getter supporter of the present invention.

An example of using the getter supporter of the present invention in the a field emission display (FED) is explained by referring to FIG. 8.

FIG. 8 is an explanatory diagram of mounting the getter on the field emission display by using the getter supporter of the present invention.

In FIG. 8, the FED comprises a cathode panel 3 as an emission source provided in a vacuum container composed of a front panel 1 made of glass and a back panel 2. The front panel 1 has a fluorescent screen 4 composed of red (R), green (G), and blue (B) on the inner wall thereof. The back panel 2 is sealed with the front panel 1 in a matched relation, and the inside space enclosed by the front panel 1 and the back panel 2 is evacuated to be a vacuum. The cathode panel 3 has multiple fine cold cathodes formed on a base plate (not shown).

The getter supporter 20 of the present invention is mounted on a side wall 5 of the field emission display. That is, the getter 30 is disposed closely to the back panel 2 by means of the contact support portion 24 of the getter supporter 20. Therefore, fine cracks of the back panel 2 due to heat generation of the getter 30 when flashing the getter 30 and heat generation of the support portion by high frequency for heating are avoided, and also deformation of the getter supporter 20 by heat conducted to the contact support portion 24 and the spring pressure can be avoided.

The getter supporter of the present invention brings about the following effects, and the manufacturing cost of the cathode-ray tube and the flat display device can be significantly reduced.

1. Even if the getter temperature for getter flashing reaches about 1300° C., this heat is hardly conducted to the contact support portion through the supporter, so that the temperature of the contact portion is not raised so high, and hence fine glass cracks are not generated.

2. Since the contact support portion is prevented from floating above the funnel glass, if spring pressure is applied, the supporter is not deformed by the heat of getter flashing due to this spring pressure.

3. By using the getter supporter of the present invention, there is a sufficient allowance in spring pressure, so that the getter supporter can be commonly used easily, and the variety of getter supporters can be decreased.

4. In the getter supporter of the present invention, the manufacturing allowance such as getter flashing condition or the like is widened, so that formation of fine cracks of funnel glass can be prevented.

Having described preferred embodiments of the present invention with reference to the accompanying drawings, it is to be understood that the present invention is not limited to those precise embodiments and that various changes and modifications could be effected therein by one skilled in the art without departing from the spirit or scope of the present invention as defined in the appended claims.

What is claimed is:

1. A cathode-ray tube having a getter on an inner surface of a funnel comprising:

getter supporter which has:

mounting portion to be fixed to an inside of the cathode-ray tube at one end thereof;

getter holder for holding a getter at the other end thereof; and spring portion for connecting said mounting portion and said getter holder, wherein a contact support portion serving as a fulcrum for contacting with a funnel glass is provided on said spring portion at a place distant a portion from the getter holder and an outer circumference of the getter by 3 mm or more to a side of the mounting portion, whereby a fine crack of the funnel glass due to heat generation of the getter at getter flashing and heat generation due to high frequency for heating can be prevented, and also a deformation of the getter supporter by eat and spring pressure can be prevented.

2. A getter supporter of a cathode-ray tube comprising:

a mounting portion to be fixed to an inside of the cathode-ray tube at one end thereof, a getter holder for holding a getter at the other end thereof, and a spring portion for connecting said mounting portion and said getter holder, wherein a contact support portion serving as a fulcrum for contacting with a funnel glass is provided on said spring portion at a place distant a portion from the getter holder and an outer circumference of the getter by 3 mm or more to a side of the mounting portion, whereby a fine crack of the funnel glass due to heat generation of the getter at getter flashing and heat generation due to High frequency for heating can be prevented, and also a deformation of the getter supporter by heat and spring pressure can be prevented.

3. A getter supporter of a flat display device comprising:

a mounting portion to be fixed to an inside of the flat display device at one end thereof;

a getter holder for holding a getter at the other end thereof; and a spring portion for connecting said mounting portion and said getter holder, wherein a contact support portion contacting with a panel glass is provided on said spring portion at a position spaced apart in a longitudinal direction from a position of said getter holder.

4. A getter supporter as claimed in claim 3, wherein said flat panel device includes a front panel, a back panel, and a plurality of side walls to provide a vacuum space housing said getter near the back panel.

5. A getter supporter as claimed in claim 4, wherein the getter supporter is mounted a side wall of the flat panel device.

* * * * *

UNITED STATES PATENT AND TRADEMARK OFFICE

CERTIFICATE OF CORRECTION

PATENT NO. : 6,452,322 B1
DATED : September 17, 2002
INVENTOR(S) : Takashi Mukuno et al.

It is certified that error appears in the above-identified patent and that said Letters Patent is hereby corrected as shown below:

Column 6,
Line 53, “eat” should read -- heat --.

Column 7,
Line 3, “High” should read -- high --.

Column 8,
Line 9, “mounted a” should read -- mounted on a --

Signed and Sealed this

Twenty-second Day of April, 2003

JAMES E. ROGAN
*Director of the United States Patent and Trademark Office*